United States Patent [19]

Wagner

[11] Patent Number: 4,696,235

[45] Date of Patent: Sep. 29, 1987

[54] STEEL ROADWAY FOR MAGNETIC TRACKS

[75] Inventor: Peter Wagner, Frankfurt, Fed. Rep. of Germany

[73] Assignee: Geri Engineering GmbH, Fed. Rep. of Germany

[21] Appl. No.: 760,756

[22] PCT Filed: Mar. 29, 1985

[86] PCT No.: PCT/EP85/00135

§ 371 Date: Jul. 15, 1985

§ 102(e) Date: Jul. 15, 1985

[30] Foreign Application Priority Data

Apr. 3, 1984 [DE] Fed. Rep. of Germany ..... 3412401

[51] Int. Cl.[4] ..... E01B 25/08; B60L 13/04

[52] U.S. Cl. ..... 104/124; 104/118; 104/281; 104/282; 104/290

[58] Field of Search ..... 104/118, 124, 281, 282, 104/286, 290, 294; 52/668, 818, 819, 820

[56] References Cited

U.S. PATENT DOCUMENTS

| | | | |
|---|---|---|---|
| 2,454,583 | 11/1948 | Wisely | 52/668 X |
| 3,300,936 | 1/1967 | Travaglia | 52/668 X |
| 3,360,892 | 1/1968 | Rosso | 52/668 X |
| 3,807,116 | 4/1974 | Flynn | 52/820 X |

FOREIGN PATENT DOCUMENTS

| | | | |
|---|---|---|---|
| 2744367 | 4/1979 | Fed. Rep. of Germany | 104/124 |
| 2914907 | 10/1980 | Fed. Rep. of Germany | 104/124 |
| 3111385 | 1/1983 | Fed. Rep. of Germany | 104/281 |
| 1069129 | 7/1954 | France | 104/118 |
| 817993 | 8/1959 | United Kingdom . | |

*Primary Examiner*—Randolph A. Reese

*Attorney, Agent, or Firm*—Scully, Scott, Murphy & Presser

[57] ABSTRACT

The roadway support of a steel roadway for magnetic tracks includes a cover plate (3) as an upper securing member which at the lower side of its two extending longitudinal edges is welded a side guiderail (4). Parallel to the guiderail and at a spacing thereto is a web-shaped longitudinal support (5) welded thereto, which carries the axial stator components (6). Extending at right angles to the longitudinal support (5) are spaced cross-support (8) which respectively pass as a unitary web connector between the two side guiderails (4). In their crossing region, the longitudinal supports (5) and the cross-supports (8) incorporate oppositely directed cutouts (9) and (10). The longitudinal support is fastened to only one of the two perpendicular side edges of the cutout (10) in the cross-support (8) through a welding seam (17) (FIG. 3).

2 Claims, 6 Drawing Figures

STEEL ROADWAY FOR MAGNETIC TRACKS

The present invention relates to a steel roadway for magnetic tracks including a roadway support, which includes a cover plate forming a top flange, which is connected at its lower side along its two longitudinal edges with a side guiderail, and at a spacing parallel thereto with, respectively, a flange-shaped longitudinal support for the receipt of stator components or the like, as well as being connected with flange-shaped lateral supports extending at right angles therewith.

About the year 1970 there started the development and investigation of magnetic track systems which distinguish themselves through the attainment of higher speeds, lower energy consumption and compatibility with the environment. The particular characteristic of such magnetic track systems resides in the non-contacting support and guidance of the vehicle over the track, which, as a rule, is effected electromagnetically, in special instances also implemented with permanent magnets. Moreover, the propulsion as well as the braking of the vehicle during its operative condition is also effected in a non-contacting manner relative to the tracks through the employment of closed-circuit stator or axial stator linear drive motors. Inasmuch as the vehicles of these new traffic systems impose completely different demands upon the roadways, in parallel with the development of the vehicles there were designed and constructed special roadways, which were preferably conceptualized in either elevated or subterranean constructional modes.

Hereby, in addition to roadway supports which are constructed from prestressed concrete, the employment of, in particular, steel roadway supports has gained ground, inasmuch as in these latter constructions, the connection for the operational components which, as a rule, are also constructed from steel, can be implemented in an advantageous and cost-saving manner in comparison with the current state of the technology. Designated thereby as operational components are all those constructional elements of the roadway which are necessary for the maintenance of the main functions on the part of the vehicle for the non-contacting support, guidance, and propulsion or braking, as well as the mechanical emergency stopping and braking. Hereby, as a rule, this relates to the steel side guiderails, the emergency stopping supports which are also of steel, steel support rails, the linear drive motor reaction rails, which are constituted of aluminum or copper in the case of the closed-circuit stator drive, or the axial stator components, consisting of laminated sheet metal packets with an inserted cable winding, in case of the axial stator drive. The total number of the operational components can be reduced for certain magnetic track systems through a suitable constructive configuration of the roadway support to merely three components for each support side.

Steel roadways are known (DE-OS 31 11 385), in which the operational components can be screwed onto the main support construction. When, concurrently, such solutions possess the considerable advantage that the individual operational components can be, if required, subsequently adjusted or even exchanged, they have proven themselves to be disadvantageous to the extent that because of the large number of screws or bolts which are required, there can be reached only a limited production speed. In addition thereto, the manufacturing process itself can only be automated to a certain extent.

In contrast with the above-described approach with screw-threaded operational components, steel roadways are known in which the operational components are partly or entirely welded together with the main support or carrier structure. In a known approach of that type, the side guiderail as well as the stator carrier which is also designated as the longitudinal support, which on the one hand, serves as the emergency stopping support and, on the other hand, carries the axial stator components, are fixedly interconnected with the main support structure through welding seams. Inasmuch as the side guiderail and the longitudinal support are arranged in parallel with each other in the longitudinal direction of the roadway, and both operational components are connected by lateral or cross-supports extending at right angles thereto at relatively narrow spacings with the main support, there are of necessity formed a large number of crossing points between these two operational components and the cross-supports.

In the above-described known approach, the side guiderail and the longitudinal support are constructed as continuous profiled members, whereas the cross-supports each consist of, presently, three cross-support segments, which must be fitted in between these support parts. Pursuant to this solution, the fitting in of the cross-support segments between the longitudinal supports, as well as between the longitudinal support and the side guiderail necessitates an increased manual production demand, as a result of which the production costs in general rise significantly.

Moreover, pursuant to this known solution, necessitated on the one hand by the tightness in the space between the main support connector plate, the longitudinal support and the side guiderail, and on the other hand, because of the lateral or cross-supports which cross at relatively narrow distances, the utilization of automatic welding processes is possible only to a limited extent. However, eliminated thereby is an important advantage of the welded approach in comparison with the screw-threaded approach. This is because, the desired production speed and the therewith connected cost-savings cannot be reached through the overwhelming applications of manual welds.

Finally, in this known approach, the necessary exactness in the track gauge width cannot be maintained, or only with considerable demands thereon. By means of the term track gauge width there is defined, in a magnetic track system, the distance between the outer sides of the two side guiderails of the roadway support or carrier. Due to reasons of the electromagnetic guidance of the vehicle, this track gauge width must be maintained within a narrow tolerance range of, for example, a maximum of $\pm 1.5$ mm. Since in the above-prescribed constructive formulation pursuant to the known approach, there must be added up a total of seven individual tolerances (three cross-support longitudinal tolerances, two thickness tolerances of the connector plate of the longitudinal support, as well as two thickness tolerances of the side guiderails) for determining the final track gauge width tolerance, the maintaining of the above-mentioned track gauge width tolerance is only possible with considerable cost expenditures.

Accordingly, it is an object of the present invention to extensively modify a steel roadway for magnetic tracks of the above-mentioned species, such that with an essentially simplified production, which can be especially implemented overwhelmingly with automated welding procedures, there is facilitated the maintenance of a narrow track gauge width tolerance range.

This object is inventively achieved in that each cross-support is constructed as a unitary connector extending between the two side guiderails, which presently possesses a cutout in the crossing region with the longitudinal support opening towards the edge of the cross-support, and wherein each longitudinal support is constructed comb-shaped and is presently with a cutout in the crossing region with the cross-support, which is directed opposite the cutout of the crossing cross-support.

Herewith there is achieved that not only the longitudinal supports carrying the stator components or the like, but also the crossing cross-supports can pass through in their applicable carrying direction without striking. Both supports can be prefabricated independently of each other into their final dimensions, and especially without any particular demands on the exactness in the locations of the cutouts in the crossing region. Already this capability leads to a significant savings in time and expenditures in comparison with the known approaches.

Further particular advantages are obtained due to the inventive configurating during assembly, inasmuch as hereby the cross-supports and the longitudinal supports can be built in without any kind of fitting work, by means of a simple superimposed interposition of the presently associated cutouts in the crossing region. This extensively simplified assembling sequence leads to further savings in time and expenditures.

The decisive advantage of the inventive construction finally is that the maintaining of the required track gauge width tolerance is rendered much easier in comparison with the known approaches, since by means of this invention the number of the individual tolerances which must be added up are reduced from seven to merely three individual tolerances; in effect, the longitudinal tolerance of the cross-support and the two thickness tolerances of the side guiderails. This advantage thus leads not only to further cost savings during the production, but also with great assurance are there avoided expensive finishing tasks through eventual exceeding of the tolerance limits.

Pursuant to one embodiment of the inventive concept, provision is made in that the cutouts in the cross-supports are open towards the lower free edge thereof, and that the cutouts in the longitudinal support are open towards the cover plate. As a result thereof, the longitudinal support retains a through-extending lower edge, which serves for the fastening of the stator components or the like.

Pursuant to a particularly preferred embodiment of the inventive concept there is provided that the longitudinal support contacts against one of the two vertical side edges bounding the cutout in the cross-support, and is welded together with this edge. Hereby, there is achieved, on the one hand, a sufficiently stiffening interconnection between the longitudinal supports and the cross-supports at the crossing points, whereby the necessary welding seam length will be quite significantly reduced in comparison with the known construction; namely, down to about one-quarter. Besides the direct savings in time and expenditures of this simplified welding seam connection, this reduction in the welding seam length also leads to a significant reduction in the deformation of the roadway support caused by the welding procedure, as well as that of the longitudinal supports and the cross-supports. Since the welding seams which must be implemented in the crossing region are relatively short, the necessary time and cost demand during the production is only slightly influenced, when the welding seams in the crossing region, due to its restricted accessibility, cannot be implemented by means of an automated welding procedure but are effected by hand.

Instead of the foregoing, the longitudinal supports and the cross-supports can also be connected by means of bolt or screw connections at their crossing locations. Along the bottom edge of the longitudinal support there can be welded, or preferably detachably attached, fastener elements for the stator components or the like. The detachable attachment has the special advantage that the longitudinal support is constructed as only a smooth connector, so that the welding seams, which connect the longitudinal support and the side guiderail with the cover plate, are readily accessible. Provided, on the one side, between the longitudinal support and the connector plate of the main support, and, on the other side, between the longitudinal support and the side guiderail, is adequate space in order to be able to weld the longitudinally-extending connecting weld seam to the cover plate with an automatic high-production welding procedure. This utilization of extensively or fully automatically working welding machines leads not only to significant savings in time and expenditures, but in addition thereto, because of the uniformity of the introduction of heat, reduces the extent of the deformations of the neighboring components caused by the welding.

A particular advantage of the detachable attachment of the fastener elements on the longitudinal supports, preferably by means of bolt or screw connections, consists of in that during the attachment of the fastener element to the longitudinal support, there are not initiated any further changes in the shape of the longitudinal support or other neighboring components, so that any eventual corrective work procedures can be precluded.

The invention is now described hereinbelow on the basis of exemplary embodiments, which are illustrated in the drawings; in which.

Figure 1:
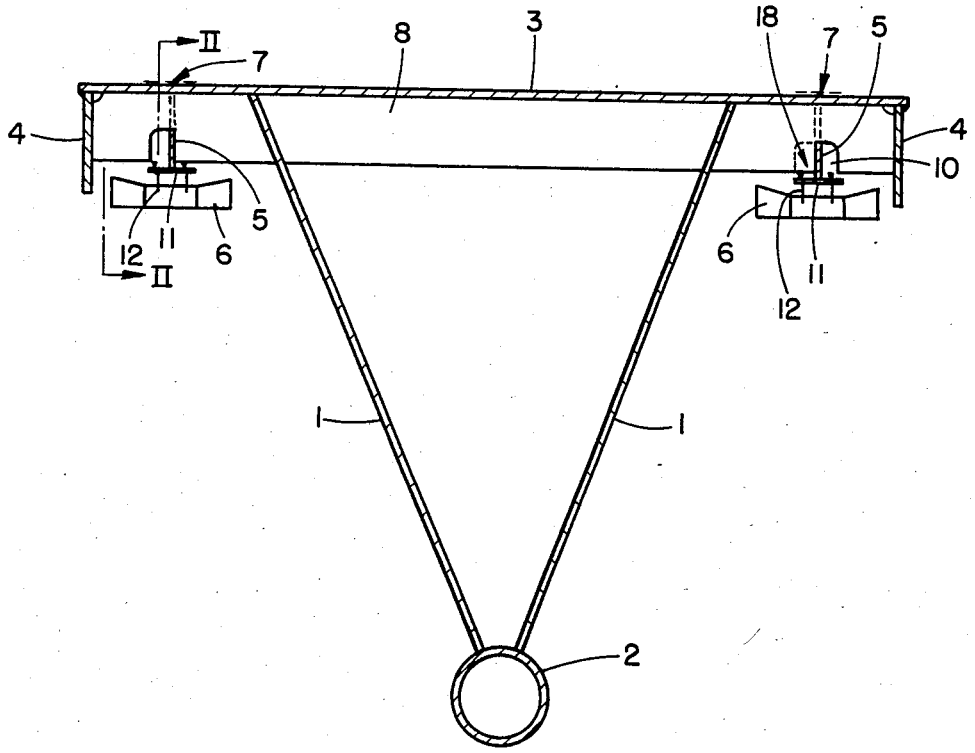
FIG. 1 illustrates a simplified vertical section through a roadway support for magnetic tracks.

The roadway support which is illustrated in section in FIG. 1 as a welded steel structure is shaped in a triangular cross-section and possesses two main connector plates 1, which are connected with a tubular profile member 2 forming a lower securing member and a cover plate 3 forming an upper securing member. The cover plate 3 projects at both sides beyond the main connector plates 1, and carries a side guiderail 4 below each of its two respective longitudinal edges.

In parallel with and at a spacing relative to the side guiderail 4, there is presently welded to the bottom side of the cover plate 3 a flange or web-shaped longitudinal support 5, which in the illustrated exemplary embodiment carries the axial stator component 6 which are required for the carrying and for the propulsion of the vehicle. Provided on the upper surface of the cover plate 3 are the emergency sliding surfaces 7 which are indicated through phantom-lines above the longitudinal supports 5 in FIG. 1, on which the vehicle will mechanically support itself, for example, during a power failure.

Welded to the lower side of the cover plate 3 at regular intervals are flange or web-shaped lateral cross-supports 8, which are presently constructed as unitary connector webs extending between the two side guiderails 4. As can be particularly clearly ascertained from FIG. 2, the longitudinal support 5 is constructed tooth-like or comb-shaped and presently is provided, in the crossing region with a cross-support 8, with a cutout 9 which opens towards the cover plate 3.

Each cross-support 8 is also provided with a cutout 10 in the crossing region with the longitudinal support 5, which is directed towards the lower edge of the cross-support 8, in effect, opposite the cutout 9 in the longitudinal support 5.

Figure 2:
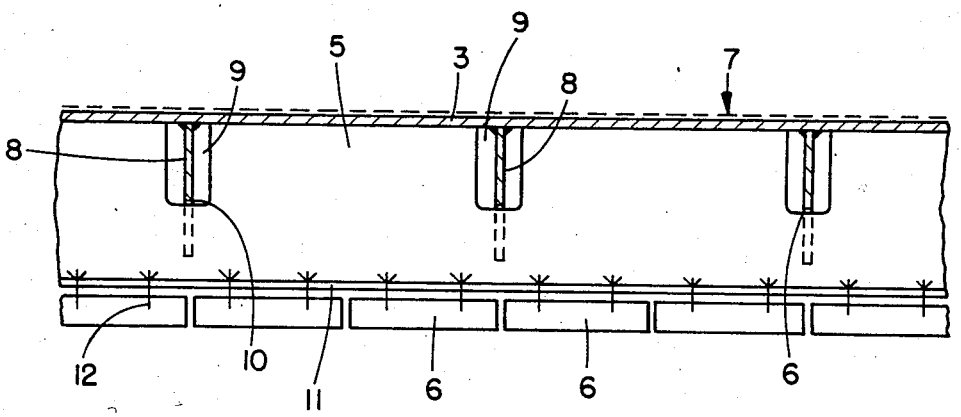
FIG. 2 is an enlarged scale partial section taken along line II—II in FIG. 1.

In the exemplary embodiment illustrated in FIGS. 1 and 2, a flange strip 11 which is welded to the lower edge of the longitudinal support 5, forms the fastening element for the axial stator components 6 and is connected to the latter by means of bolts 12.

Figure 3:
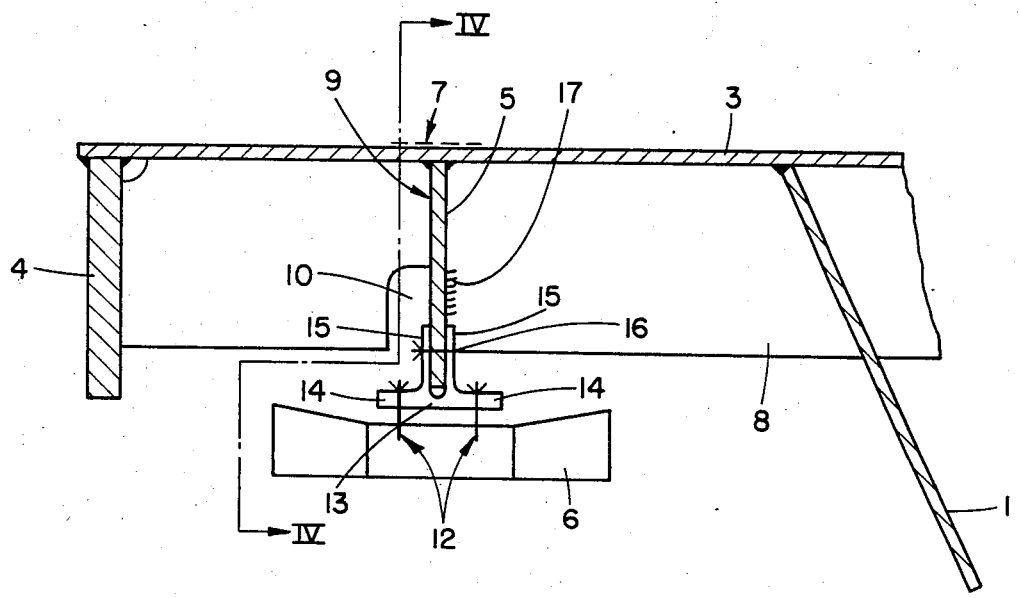
FIG. 3 is an enlarged scale partial section similar to FIG. 1, showing a modified embodiment.
Figure 4:
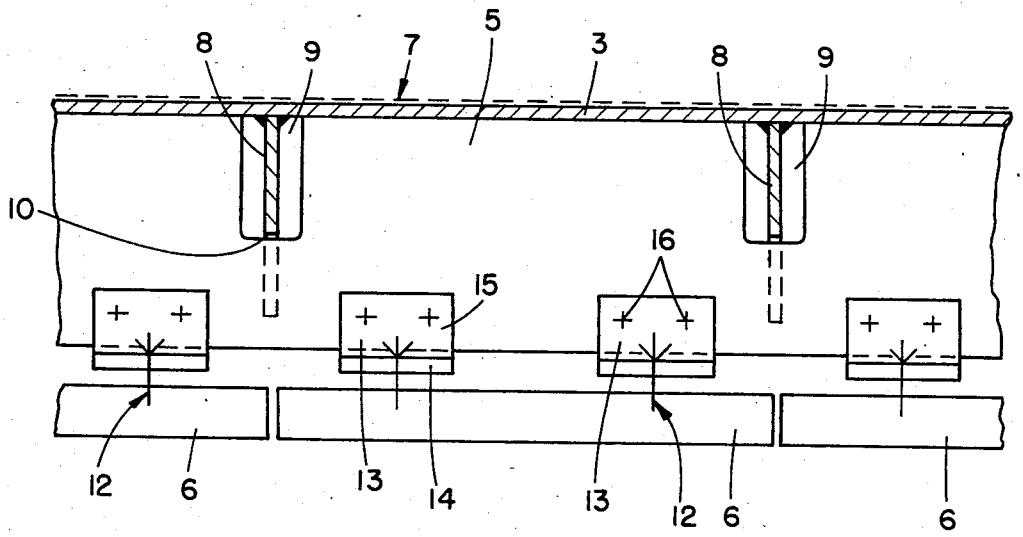
FIG. 4 is a partial section taken along line IV—IV in FIG. 3.

Distinguishing thereover in the exemplary embodiment illustrated in FIGS. 3 and 4, wherein for the remaining elements there are employed the same reference numerals for the same components as in FIGS. 1 and 2, is only that the fastener elements 13 for the axial stator components 6 are individual elements which are detachably screwed or bolted onto the longitudinal support 5, which each possess horizontal flange plates 14 which carry the bolts 12. Projecting upwardly from the flange plates 14 are two connector plates 15 upwardly, which are fastened to the therebetween located lower edge of the longitudinal support 5 by means of threaded or bolt connections 16.

Figure 1A:
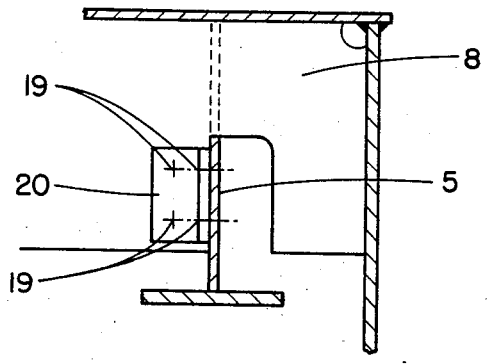
FIG. 1A is a fragmentary portion of FIG. 1, shown on an enlarged scale.
Figure 2A:
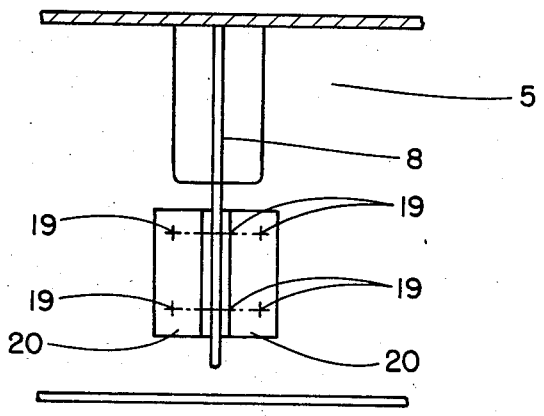
FIG. 2A is a fragmentary portion of FIG. 2, shown on an enlarged scale.

From FIG. 3 there can be particularly clearly recognized that, just as in the embodiment pursuant to FIGS. 1 and 2, the longitudinal support 5 contacts against one of the two vertical side edges bounding the cutout 10 in the cross-support 8, and is connected therewith through the welding seam 17. Towards the right in FIG. 1 there is indicated by means of phantom-lines, that instead of the former, there can also be provided a threaded or bolt connection 18, which as shown in FIGS. 1A and 2A, are the angled fastener elements or bolts 19 and 20 interconnecting supports 5 and 8.

With regard to the term "flange or web-shaped" which has been employed in defining the longitudinal supports 5 and the cross-supports 8, this pertains to any kind of configurations in which a flat rib extends perpendicular to the cover plate 3, wherein the connector or the rib can also be connected with other profiled members; for example, by being welded thereto or integrally formed therewith.

I claim:

1. A steel roadway for magnetic tracks with a roadway support, including a cover plate forming an upper securing member, which is connected at its lower side along the two longitudinal edges thereof with a side guiderail and at a spacing in parallel therewith, with respectively a web-shaped longitudinal support for the receipt of stator components or the like, including web-shaped cross-supports extending at right angles thereto, characterized in that each said cross-support (8) is constructed as a unitary web extending between the two side guiderails (4), which incorporates a cutout (10) in the crossing region with the longitudinal support (5) opening towards the edge of the cross-support (8), and wherein each said longitudinal support (5) is constructed comb-shaped and incorporates a cutout (9) in the crossing region with the cross-support (8) which is directed opposite to the cutout (10) in the cross-support (8), said cutouts (10) in the cross-supports (8) opening towards the lower free edge thereof, and the cutouts (9) of the longitudinal supports (5) opening towards the cover plate (3), the longitudinal support (5) contacting one of the two perpendicular side edges bounding the cutout (10) the cross-support (8), and being welded to said side edge, or the longitudinal supports (5) and the cross-supports (8) are interconnected at their crossing locations through threaded bolt connections (18), and fastening elements (11,13) for the stator components (6) or the like being welded or detachably attached to the lower edge of the longitudinal supports (5).

2. Steel roadway as claimed in claim 1, wherein the fastening elements (13) each include horizontal flange plates (14), from which two flange plates (15) project upwardly and which are fastened to the therebetween located lower edge of the longitudinal support (5) through threaded bolt connections (16).

* * * * *